US006540229B1

(12) United States Patent
Smith et al.

(10) Patent No.: US 6,540,229 B1
(45) Date of Patent: Apr. 1, 2003

(54) CARD GAME APPARATUS

(76) Inventors: Linda E. Smith, 24761 Manila St., Harrison Township, MI (US) 48045; Michael C. Smith, 24761 Manila St., Harrison Township, MI (US) 48045

( * ) Notice: Subject to any disclaimer, the term of this patent is extended or adjusted under 35 U.S.C. 154(b) by 0 days.

(21) Appl. No.: 10/122,845

(22) Filed: Apr. 12, 2002

(51) Int. Cl.[7] ..... A63F 3/00
(52) U.S. Cl. ..... 273/274; 273/280; 273/292
(58) Field of Search ..... 273/280, 138.1, 273/142 R, 142 J, 292, 309, 274

(56) References Cited

U.S. PATENT DOCUMENTS

| | | | | |
|---|---|---|---|---|
| D103,207 | S | | 2/1937 | Baack et al. |
| 2,133,746 | A | | 10/1938 | Hawgood |
| D137,206 | S | | 2/1944 | Pickup |
| D173,692 | S | | 12/1954 | Bauer |
| 2,907,123 | A | * | 10/1959 | McMahon |
| 3,195,896 | A | * | 7/1965 | Markham |
| 4,346,900 | A | | 8/1982 | Lamlee |
| 4,948,145 | A | * | 8/1990 | Breslow |
| 5,445,388 | A | | 8/1995 | Mitchen |
| 6,217,022 | B1 | * | 4/2001 | Astaneha |

OTHER PUBLICATIONS

"Three in One", Rules of Card Games: Tripoli, Web page at http://www.pagat.com/stops/3in1.html, Aug., 2002.*

* cited by examiner

*Primary Examiner*—William M. Pierce

(57) ABSTRACT

A card game apparatus for playing cards. The card game apparatus being played with a deck of cards having a letter, symbol and numerical indicia marked thereon. The card game apparatus also utilizes game chips in conjunction with a game board that has an upper surface with a plurality of jackpot areas. A plurality of windows is formed in the upper surface and is associated with one of the jackpot areas. A plurality of game board indicia is marked on an upper surface of the game board and is associated with one of the jackpot areas. A rotatably mounted wheel member is positioned below the upper surface of the game board such that portions of wheel indicia positioned on the wheel member are viewable through the windows when the wheel member is rotated between different positions, thereby defining a variety of setups for game play.

16 Claims, 2 Drawing Sheets

CARD GAME APPARATUS

BACKGROUND OF THE INVENTION

1. Field of the Invention

The present invention relates to card games and more particularly pertains to a new card game apparatus for playing cards. The card game being played with a deck of cards having a letter, symbol and numerical indicia marked thereon.

2. Description of the Prior Art

The use of card games is known in the prior art. More specifically, card games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,346,900; U.S. Pat. No. 5,445,388; U.S. Pat. No. des. 173,692; U.S. Pat. No. Des. 137,206; U.S. Pat. No. Des. 103,207; and U.S. Pat. No. 2,133,746.

While these devices fulfill their respective, particular objectives and requirements, the aforementioned patents do not disclose a new card game apparatus. The inventive device includes a plurality of chips and a game board that has an upper surface and a cavity. The game board includes a plurality of jackpot areas for receiving at least one of the chips from each of the players. A wheel member is rotatably mounted in the cavity of the game board. The wheel member includes a plurality of indicia marked thereon that is visible through the game board. The plurality of indicia corresponds to the symbol and numerical indicia of the playing cards. In one embodiment of the present invention, a player wins the plurality of chips in each of the jackpot areas by laying down a playing card that has indicia matching the indicia marked on the wheel member.

In these respects, the card game apparatus according to the present invention substantially departs from the conventional concepts and designs of the prior art, and in so doing provides an apparatus primarily developed for the purpose of playing cards. The card game being played with a deck of cards having a letter, symbol and numerical indicia marked thereon.

SUMMARY OF THE INVENTION

In view of the foregoing disadvantages inherent in the known types of card games now present in the prior art, the present invention provides a new card game apparatus construction wherein the same can be utilized for playing cards. The card game being played with a deck of cards having a letter, symbol and numerical indicia marked thereon.

The general purpose of the present invention, which will be described subsequently in greater detail, is to provide a new card game apparatus apparatus and method which has many of the advantages of the card games mentioned heretofore and many novel features that result in a new card game apparatus which is not anticipated, rendered obvious, suggested, or even implied by any of the prior art card games, either alone or in any combination thereof.

To attain this, the present invention generally comprises a plurality of chips and a game board that has an upper surface and a cavity. The game board includes a plurality of jackpot areas for receiving at least one of the chips from each of the players. A wheel member is rotatably mounted in the cavity of the game board. The wheel member includes a plurality of indicia marked thereon that is visible through the game board. The plurality of indicia corresponds to the symbol and numerical indicia of the playing cards. In one embodiment of the present invention, a player wins the plurality of chips in each of the jackpot areas by laying down a playing card that has indicia matching the indicia marked on the wheel member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new card game apparatus apparatus and method which has many of the advantages of the card games mentioned heretofore and many novel features that result in a new card game apparatus which is not anticipated, rendered obvious, suggested, or even implied by any of the prior art card games, either alone or in any combination thereof.

It is another object of the present invention to provide a new card game apparatus which may be easily and efficiently manufactured and marketed.

It is a further object of the present invention to provide a new card game apparatus which is of a durable and reliable construction.

An even further object of the present invention is to provide a new card game apparatus which is susceptible of a low cost of manufacture with regard to both materials and labor, and which accordingly is then susceptible of low prices of sale to the consuming public, thereby making such card game apparatus economically available to the buying public.

Still yet another object of the present invention is to provide a new card game apparatus which provides in the apparatuses and methods of the prior art some of the advantages thereof, while simultaneously overcoming some of the disadvantages normally associated therewith.

Still another object of the present invention is to provide a new card game apparatus for playing cards. The card game being played with a deck of cards having a letter, symbol and numerical indicia marked thereon.

Yet another object of the present invention is to provide a new card game apparatus that utilizes game chips and playing cards in conjunction with a game board that has an upper surface with a plurality of jackpot areas. A plurality of windows is formed in the upper surface and is associated with one of the jackpot areas. A plurality of game board indicia is marked on an upper surface of the game board and is associated with one of the jackpot areas. A rotatably mounted wheel member is positioned below the upper surface of the game board such that portions of wheel indicia positioned on the wheel member are viewable through the windows when the wheel member is rotated between different positions, thereby defining a variety of setups for game play.

Still yet another object of the present invention is to provide a new card game apparatus that provides hours of enjoyment.

Even still another object of the present invention is to provide a new card game apparatus that can be played by persons of all ages.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
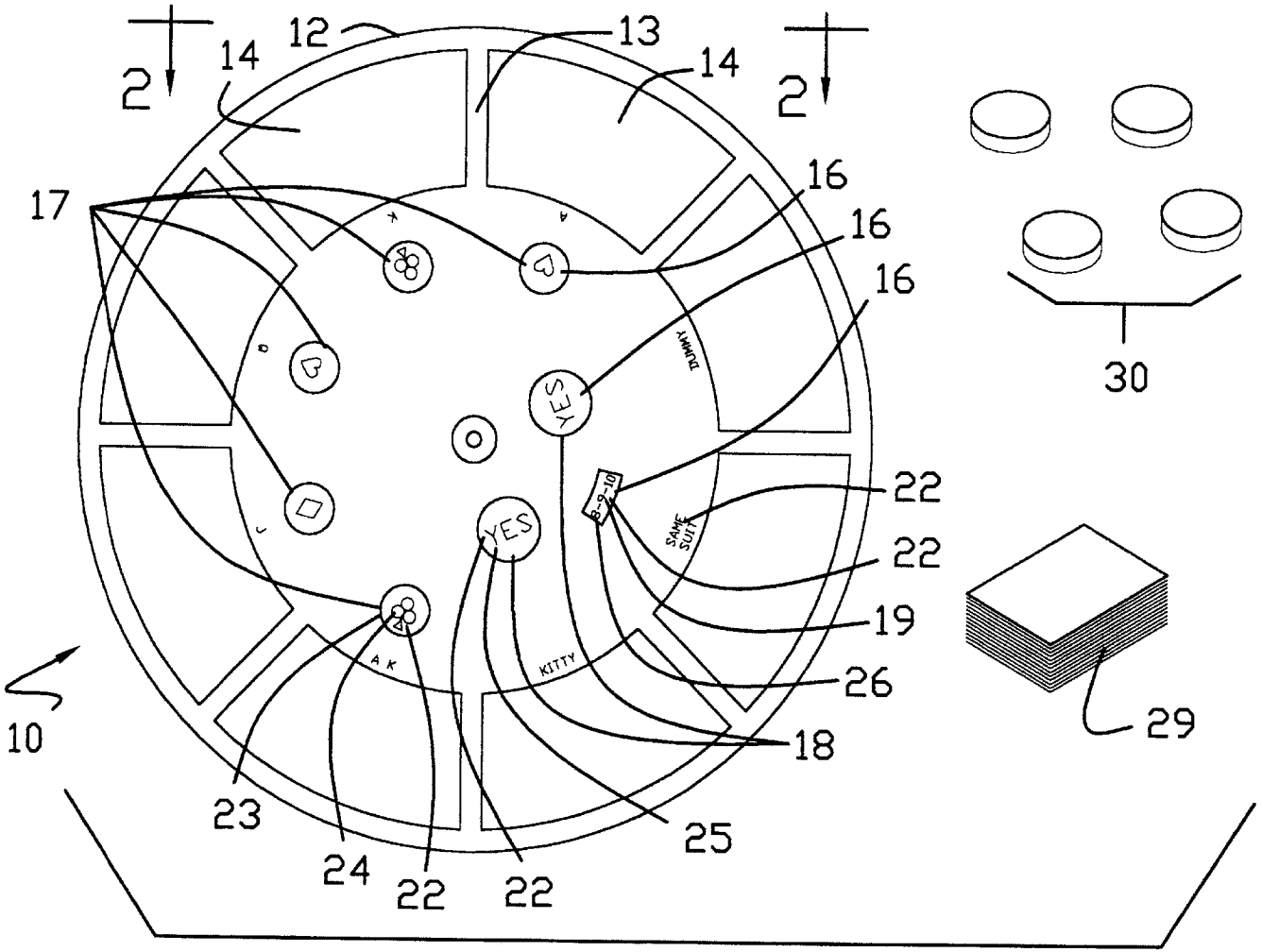
FIG. 1 is a schematic top view of a new card game apparatus according to the present invention.
Figure 2:
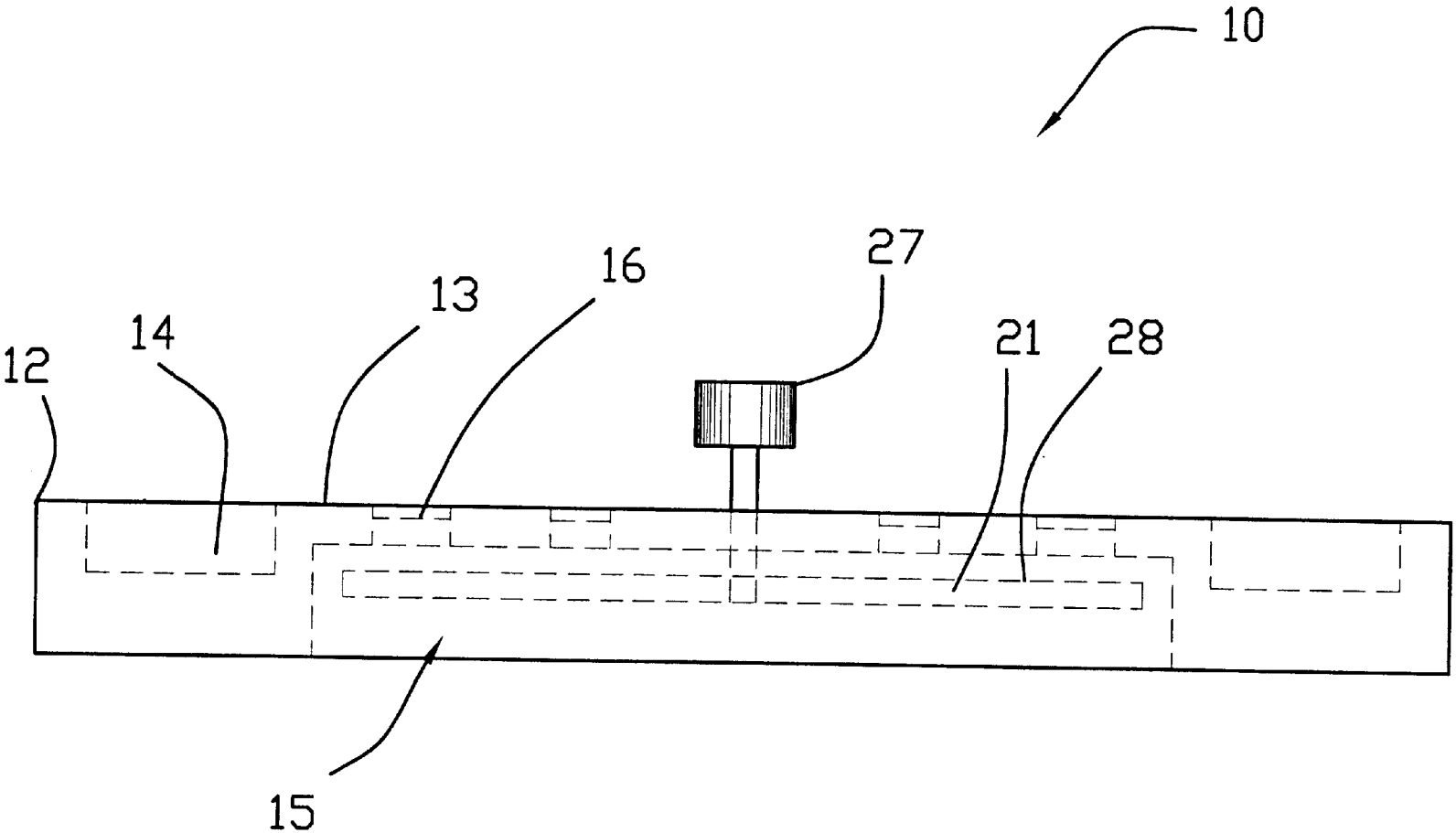
FIG. 2 is a schematic cross-sectional side view of the present invention taken along line 2—2 of FIG. 1.

With reference now to the drawings, and in particular to FIGS. 1 through 2 thereof, a new card game apparatus embodying the principles and concepts of the present invention and generally designated by the reference numeral 10 will be described.

As best illustrated in FIGS. 1 through 2, the card game apparatus 10 generally comprises a game board 12 that has an upper surface 13 with a plurality of jackpot areas 14. The game board 12 includes a cavity 15 formed in the game board 12 beneath the upper surface 13.

A plurality of windows 16 is formed in the upper surface 13 and into the cavity 15. A portion of each of the windows is spatially associated with one of the jackpot areas 14.

The plurality of windows 16 includes a first set 17 of five windows, a second set 18 of two windows, and a third set 19 of one window.

A plurality of game board indicia 20 is marked on the upper surface 13 of the game board 12. Each of the game board indicia 20 is located adjacent to one of the jackpot areas 14. The game board indicia 20 includes "A", "K", "Q", "J", "AK", "KITTY", "SAME SUIT", and "DUMMY".

One each of the first set 17 of windows is positioned adjacent to the jackpot areas 14 associated with "A", "K", "Q", "J", and "AK".

One each of the second set 18 of windows is positioned adjacent to the jackpot areas 14 associated with "DUMMY" and "KITTY".

The window of the third set 19 of windows is positioned adjacent to the jackpot area 14 associated with "SAME SUIT".

A wheel member 21 is positioned below the upper surface 13 of the game board 12 such that the wheel member 21 is viewable through the plurality of windows 16 in the game board 12. The wheel member 21 is located in the cavity 15 of the game board 12.

The wheel member 21 includes a plurality of wheel indicia 22 marked on the wheel member 21 in a manner such that a portion of the plurality of wheel indicia 22 is viewable through the windows 16 in the game board 12.

The plurality of wheel indicia 22 includes a first group 23 of wheel indicia 22 that has suit symbols 24.

The plurality of wheel indicia 22 includes a second group 25 of wheel indicia 22 that includes "YES" and "NO".

The plurality of wheel indicia 22 includes a third group 26 of wheel indicia 22 that has at least two combinations of three sequential numbers chosen from whole numbers between 2 and 10.

The wheel member 21 is rotatably mounted on the game board 12 such that a first portion of the first set 17 of wheel indicia 22 is viewable through the first set 17 of windows when the wheel member 21 is at a first rotational position, and a second portion of the first set 17 of wheel indicia 22 is viewable through the first set 17 of windows when the wheel member 21 is at a second rotational position.

A first portion of the second set 18 of wheel indicia 22 is viewable through the second set 18 of windows when the wheel member 21 is at the first rotational position, and a second portion of the second set 18 of wheel indicia 22 is viewable through the second set 18 of windows when the wheel member 21 is at the second rotational position.

A first portion of the third set 19 of wheel indicia 22 is viewable through the third window when the wheel member 21 is at the first rotational position, and a second portion of the third set 19 of wheel indicia 22 is viewable through the third window when the wheel member 21 is at the second rotational position.

The first and second portions of the first set 17 of wheel indicia 22 includes different suit symbols 24 simultaneously viewable through the first set 17 of windows.

At least four different suit symbols 24 are viewable through the first set 17 of windows at any of the rotational positions of the wheel member 21.

A knob 27 is mounted on a top surface 28 of the wheel member 21 and extends through the upper surface 13 of the game board 12 such that rotation of the knob 27 by a player causes rotation of the wheel member 21.

Both a plurality of playing cards 29 and a plurality of game chips 30 are utilized in conjunction with the game board 12.

Each of the jackpot areas 14 includes a jackpot recess 31 that extends into the upper surface 13 of the game board 12 for receiving the game chips 30.

In use, the game consists of playing a first round using the wheel indicia 22 showing through the windows 16 when the wheel member 21 is in the first rotational position, then rotating the wheel member 21 to the second rotational position and playing a second round of the game using the wheel indicia 22 shown in the windows 16.

A dealer is selected from a plurality of players. Each player places at least one game chip 30 in each of the jackpot areas 14. The dealer deals a portion of a plurality of cards 29 to each of the players.

The dealer places one of the cards 29 in a jackpot area associated with one of the game board indicia 20 which comprises "DUMMY".

Each one of the players places one of the cards 29 down. Each of the players alternately places playing cards 29 down in a sequential numerical order that have a common suit symbol 24 indicia.

Any of the players unable to place one of the cards 29 down that has the common suit symbol 24 indicia in a sequential numerical order is skipped.

The players able to place down one the playing cards 29 that has a suit symbol 24 indicia corresponding to the suit symbol 24 of the first group 23 of wheel indicia 22 marked on the wheel member 21 viewable through each one of the first set 17 of windows 16 positioned adjacent to each of the jackpot areas 14 wins the chips in the corresponding jackpot area.

To win the chips 30 in the jackpot area associated with the game board indicia 20 "DUMMY", a player must place one of the playing cards 29 that has suit symbol 24 indicia corresponding to the wheel indicia 22 viewable through the window associated with the jackpot area associated with "DUMMY".

To win the chips 30 in the jackpot area associated with the game board indicia 20 "SAME SUIT", a player must place one of the playing cards 29 that has suit symbol 24 indicia corresponding to the wheel indicia 22 viewable through the window associated with the jackpot area associated with "SAME SUIT".

To win the chips 30 in the jackpot area associated with the game board indicia 20 "KITTY", a player must place all of their playing cards 29 down by playing all of them.

The game is won by collecting all of the game chips 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A card game system for playing cards, said card game being played with a deck of cards, each of the playing cards having a symbol indicia marked thereon, a portion of the playing cards having a letter indicia marked thereon, a portion of the playing cards having a numerical indicia marked thereon, said card game system comprising:

a game board apparatus comprising:

a game board having an upper surface with a plurality of jackpot areas, said game board including:

a plurality of windows being formed in said upper surface, a portion of said plurality of windows each being spatially associated with one of said jackpot areas, said plurality of windows including a first set of windows;

a plurality of game board indicia being marked on said upper surface of said game board, each of said plurality of game board indicia being spatially associated with one of said jackpot areas; and a wheel member being positioned below said upper surface of said game board such that said wheel member is viewable through said plurality of windows in said game board, said wheel member including:

a plurality of wheel indicia being marked on said wheel member in a manner such that a portion of said plurality of wheel indicia are viewable through said plurality of windows in said game board, said plurality of wheel indicia including a first set of wheel indicia comprising suit symbols;

wherein said wheel member is rotatably mounted on said game board such that a first portion of said first set of wheel indicia is viewable through said first set of windows when said wheel member is at a first rotational position, and a second portion of said first set of wheel indicia is viewable through said first set of windows when said wheel member is at a second rotational position;

wherein said plurality of windows includes a second set of windows and a third set of at least one window;

wherein said plurality of game board indicia includes "A", "K", "Q", "J", "AK", "KITTY", "SAME SUIT", and "DUMMY";

wherein said first set of windows of said plurality of windows spatially associated with said jackpot areas are each positioned adjacent to said jackpot areas associated with "A", "K", "Q", "J", and "AK";

wherein said second set of windows of said plurality of windows spatially associated with said jackpot areas are each positioned adjacent to said jackpot areas associated with "DUMMY" and "KITTY"; and wherein said third set of at least one window of said plurality of windows spatially associated with said jackpot areas is positioned adjacent to said jackpot area associated with "SAME SUIT".

2. The card game system of claim 1, wherein said plurality of wheel indicia includes a second set of indicia wheel comprising "YES" and "NO", and said plurality of wheel indicia includes a third set of indicia comprising at least two combinations of three sequential numbers chosen from whole numbers between 2 and 10.

3. The card game system of claim 1, wherein said plurality of wheel indicia includes a second set of indicia and said plurality of windows includes a second set of windows, a first portion of said second set of wheel indicia being viewable through said second set of windows when said wheel member is at the first rotational position, and a second portion of said second set of wheel indicia is viewable through said second set of windows when said wheel member is at a second rotational position.

4. The card game system of claim 3, wherein said plurality of wheel indicia includes a third set of wheel indicia and said plurality of windows includes a third set of at least one window, a first portion of said third set of wheel indicia being viewable through said third set of at least one window when said wheel member is at a first rotational position, and a second portion of said third set of wheel indicia is viewable through said third set of at least one window when said wheel member is at a second rotational position.

5. The card game system of claim 1, wherein said first and second portions of said first set of wheel indicia include different suit symbols simultaneously viewable through said first set of windows.

6. The card game system of claim 5, wherein at least four different of said suit symbols are viewable through said first set of windows at a said rotational position of said wheel member.

7. The card game system of claim 1, additionally comprising a plurality of cards.

8. The card game system of claim 1, additionally comprising a plurality of playing chips.

9. The card game system of claim 1, wherein each of said jackpot areas includes a jackpot recess extending into said upper surface of said game board for receiving playing chips.

10. The card game system of claim 1, wherein said first set of windows comprises five windows, said second set of windows comprises two windows, and said third set of at least one window comprises a single window.

11. The card game system of claim 1, additionally comprising a knob mounted on an top surface of said wheel member and extending through the upper surface of said game board such that rotation of said knob by a player causes rotation of said wheel member.

12. The card game system of claim 1, wherein a cavity is formed in said game board beneath said upper surface, said plurality of windows extending from said upper surface to said cavity, said wheel member being located in said cavity of said game board.

13. A method of playing a card game system comprising: providing a game board apparatus comprising:

a game board having an upper surface with a plurality of jackpot areas, said game board including a plurality of windows being formed in said upper surface, a portion of said plurality of windows each being spatially associated with one of said jackpot areas, said plurality of windows including a first set of windows, said game board including a plurality of game board indicia being marked on an upper surface of said game board, each of said plurality of game board indicia being spatially associated with one of said jackpot areas;

wherein said plurality of windows includes a second set of windows and a third set of at least one window;

wherein said plurality of game board indicia includes "A", "K", "Q", "J", "AK", "KITTY", "SAME SUIT", and "DUMMY";

wherein said first set of windows of said plurality of windows spatially associated with said jackpot areas are each positioned adjacent to said jackpot areas associated with "A", "K", "Q", "J", and "AK";

wherein said second set of windows of said plurality of windows spatially associated with said jackpot areas are each positioned adjacent to said jackpot areas associated with "DUMMY" and "KITTY";

wherein said third set of at least one window of said plurality of windows spatially associated with said jackpot areas is positioned adjacent to said jackpot area associated with "SAME SUIT"; and a wheel member being positioned below said upper surface of said game board such that said wheel member is viewable through said plurality of windows in said game board, said wheel member including a plurality of wheel indicia being marked on said wheel member in a manner such that a portion of said plurality of wheel indicia are viewable through said plurality of windows in said game board, said plurality of wheel indicia including a first set of wheel indicia comprising suit symbols, wherein said wheel member is rotatably mounted on said game board such that a first portion of said first set of wheel indicia is viewable through said first set of windows when said wheel member is at a first rotational position, and a second portion of said first set of wheel indicia is viewable through said first set of windows when said wheel member is at a second rotational position;

playing a first round of a game;

rotating the wheel member from the first rotational position to the second rotational position; and playing a second round of the game.

14. The method of claim 13 wherein each of said rounds of the game comprises the steps of:

placing at least one chip in each of said jackpot areas by each of said players;

selecting a dealer from a plurality of players;

dealing a portion of a plurality of cards by the dealer to each of the players;

placing one of the cards by the dealer in a jackpot area associated with one of said game board indicia which comprises "DUMMY";

placing one of the cards down by one of the players, each of the players alternately placing playing cards down having a common suit symbol indicia in a sequential numerical order;

skipping any of said players unable to place one of said cards down having the common suit symbol indicia in a sequential numerical order.

15. The method of claim 14 wherein each of said rounds of the game comprises the steps of:

winning the chips in one of said jackpot areas by any of the players able to place down one the playing cards having a suit symbol indicia corresponding to the suit symbol of the first set of wheel indicia marked on the wheel member viewable through each one of said first set of windows positioned adjacent to each of the jackpot areas;

winning the chips in the jackpot area associated with the game board indicia "DUMMY" if one of the players places one of the playing cards having suit symbol indicia corresponding to the wheel indicia viewable through one of said plurality of windows associated with the jackpot area associated with "DUMMY";

winning the chips in one of the jackpot areas associated with "SAME SUIT" if one of the players places at least one of the cards having numerical indicia corresponding to the wheel indicia marked on the wheel member;

winning the chips in the kitty jackpot area if one of the players places all of said player's cards down.

16. A card game system for playing cards, said card game being played with a deck of cards, each of the playing cards having a symbol indicia marked thereon, a portion of the playing cards having a letter indicia marked thereon, a portion of the playing cards having a numerical indicia marked thereon, said card game system comprising:

a game board apparatus comprising:

a game board having an upper surface with a plurality of jackpot areas, said game board including:

a cavity formed in said game board beneath said upper surface;

a plurality of windows being formed in said upper surface and into said cavity, a portion of said plurality of windows each being spatially associated with one of said jackpot areas;

wherein said plurality of windows includes a first set of windows, second set of windows, and a third set of at least one window;

wherein said first set of windows comprises five windows, said second set of windows comprises two windows, and said third set of at least one window comprises a single window;

a plurality of game board indicia being marked on an upper surface of said game board, each of said plurality of game board indicia being located adjacent to one of said jackpot areas, said plurality of game board indicia including "A", "K", "Q", "J", "AK", "KITTY", "SAME SUIT", and "DUMMY";

wherein said first set of windows of said plurality of windows spatially associated with said jackpot areas are each positioned adjacent to said jackpot areas associated with "A", "K", "Q", "J", and "AK";

wherein said second set of windows of said plurality of windows spatially associated with said jackpot areas are each positioned adjacent to said jackpot areas associated with "DUMMY" and "KITTY";

wherein said third set of at least one window of said plurality of windows spatially associated with said jackpot areas is positioned adjacent to said jackpot area associated with "SAME SUIT";

a wheel member being positioned below said upper surface of said game board such that said wheel member is viewable through said plurality of windows in said game board, said wheel member being located in said cavity of said game board, said wheel member including:

a plurality of wheel indicia being marked on said wheel member in a manner such that a portion of said plurality of wheel indicia are viewable through said plurality of windows in said game board, said plurality of wheel indicia including a first set of wheel indicia comprising suit symbols, said plurality of wheel indicia including a second set of wheel indicia comprising "YES" and "NO", said plurality of wheel indicia including a third set of wheel indicia comprising at least two combinations of three sequential numbers chosen from whole numbers between 2 and 10;

wherein said wheel member is rotatably mounted on said game board such that a first portion of said first set of wheel indicia is viewable through said first set of windows when said wheel member is at a first rotational position, and a second portion of said first set of wheel indicia is viewable through said first set of windows when said wheel member is at a second rotational position;

wherein a first portion of said second set of wheel indicia is viewable through said second set of windows when said wheel member is at the first rotational position, and a second portion of said second set of wheel indicia is viewable through said second set of windows when said wheel member is at a second rotational position;

wherein a first portion of said third set of wheel indicia is viewable through said third set of at least one window when said wheel member is at a first rotational position, and a second portion of said third set of wheel indicia is viewable through said third set of at least one window when said wheel member is at a second rotational position;

wherein said first and second portions of said first set of wheel indicia including different suit symbols simultaneously viewable through said first set of windows;

wherein at least four different of said suit symbols are viewable through said first set of windows at a rotational position of said wheel member;

a knob mounted on an top surface of said wheel member and extending through the upper surface of said game board such that rotation of said knob by a player causes rotation of said wheel member;

a plurality of cards; and a plurality of chips;

wherein each of said jackpot areas includes a jackpot recess extending into said upper surface of said game board for receiving said chips.

* * * * *